US008796937B2

(12) United States Patent
Wang et al.

(10) Patent No.: US 8,796,937 B2
(45) Date of Patent: Aug. 5, 2014

(54) DRIVER CIRCUIT FOR LIGHT-EMITTING DEVICE

(75) Inventors: Wen-Chun Wang, Taichung (TW); Wen-Tui Liao, Tai Chung (TW); Tsung-Yu Wang, Taichung (TW)

(73) Assignees: Wintek Technology (H.K) Ltd., Dongguan, Guangdong Province (TW); Wintek Corporation, Taichung (TW)

( * ) Notice: Subject to any disclaimer, the term of this patent is extended or adjusted under 35 U.S.C. 154(b) by 157 days.

(21) Appl. No.: 13/290,318

(22) Filed: Nov. 7, 2011

(65) Prior Publication Data

US 2012/0112652 A1 May 10, 2012

(30) Foreign Application Priority Data

Nov. 5, 2010 (TW) ..... 99138110 A

(51) Int. Cl.
*G09G 3/10* (2006.01)

(52) U.S. Cl.
USPC ..... 315/169.3; 315/169.2; 345/76; 345/82

(58) Field of Classification Search
USPC ..... 315/169.1–169.4, 291–295, 299, 315/307–308, 312
See application file for complete search history.

(56) References Cited

U.S. PATENT DOCUMENTS

| | | | | |
|---|---|---|---|---|
| 7,768,483 | B2 * | 8/2010 | Chan et al. | 345/76 |
| 2005/0225251 | A1 * | 10/2005 | Hsueh | 315/169.2 |
| 2006/0256057 | A1 * | 11/2006 | Han et al. | 345/92 |
| 2007/0040792 | A1 * | 2/2007 | Kwag et al. | 345/100 |
| 2007/0080905 | A1 * | 4/2007 | Takahara | 345/76 |
| 2007/0195018 | A1 * | 8/2007 | Chiou et al. | 345/76 |
| 2008/0074359 | A1 * | 3/2008 | Chung | 345/76 |
| 2008/0297495 | A1 * | 12/2008 | Jung et al. | 345/204 |
| 2011/0279434 | A1 * | 11/2011 | Akimoto et al. | 345/211 |

* cited by examiner

*Primary Examiner* — Thienvu Tran
*Assistant Examiner* — Christopher Lo
(74) *Attorney, Agent, or Firm* — Muncy, Geissler, Olds & Lowe, P.C.

(57) ABSTRACT

A driver circuit for a light-emitting device includes a light-emitting device, a data receiving unit, a storage unit, a driver unit and a voltage divider. The data receiving unit receives a data signal, the storage unit stores a capacitor voltage, and a positive correlation exists between the capacitor voltage and the data signal. The driver unit is coupled to the light-emitting device, and the driver unit is turned on to drive the light-emitting device according to the capacitor voltage and to generate a threshold voltage of the driver unit. The voltage divider is coupled between the data receiving circuit and the light-emitting device and turned on by the capacitor voltage to generate a divided voltage. The voltage divider detects a voltage variation in the threshold voltage and in a voltage across the light-emitting device and adjusts the divided voltage according to the voltage variation.

18 Claims, 7 Drawing Sheets

40

DRIVER CIRCUIT FOR LIGHT-EMITTING DEVICE

BACKGROUND OF THE INVENTION (a) Field of the Invention

The invention relates to a driver circuit for a light-emitting device.

(b) Description of the Related Art

FIG. 1 is a schematic diagram of a conventional pixel circuit of an AM-OLED (active-matrix organic light-emitting diode) display. In general, a basic architecture for a conventional pixel circuit of an AM-OLED display includes two transistors and one capacitor (2T1C).

As shown in FIG. 1, the pixel circuit 10 for an AM-OLED display includes transistors M1 and M2 and a capacitor Cst. When a transistor and an OLED device in the pixel circuit 10 suffer current stress for a long time, a threshold voltage of the transistor and a voltage across the OLED device may increase to change a current flowing through the OLED device. This may decrease luminance uniformity of the AM-OLED display.

BRIEF SUMMARY OF THE INVENTION

One embodiment of the invention provides a driver circuit for a light-emitting device.

One embodiment of the invention provides an active-matrix driver circuit for an organic light-emitting diode (OLED).

According to an embodiment of the invention, the driver circuit for a light-emitting device may reduce the variation in a threshold voltage of a thin film transistor (TFT) and in a voltage across a light-emitting device to improve luminance uniformity.

According to another embodiment of the invention, the driver circuit for a light-emitting device has a storage capacitor with one end for receiving a clock signal to allow a driving thin film transistor of a display panel to alternate between a display state and a relaxation state to therefore extend its service life.

According to another embodiment of the invention, a driver circuit for a light-emitting device includes a light-emitting device, a first transistor, a second transistor, a third transistor, a capacitor and a fourth transistor. The light-emitting device is controlled by a driving current to emit light. The first transistor transmits a data signal. The second transistor is coupled between the light-emitting device and the first transistor, and the second transistor is coupled to the first transistor to form a node and generates a divided voltage on the node. The third transistor transmits the divided voltage, and the capacitor stores a capacitor voltage substantially equal to the divided voltage. The fourth transistor is coupled to the second transistor and the light-emitting device, and the fourth transistor has a threshold voltage. The threshold voltage is equal to a compensating voltage of the second transistor, and the fourth transistor is controlled by the capacitor voltage to generate the driving current. The divided voltage is in proportion to a voltage of the data signal and is used to record a voltage variation in the threshold voltage of the fourth transistor and in a voltage across the light-emitting device, and the divided voltage is adjusted according to the voltage variation.

According to another embodiment of the invention, a driver circuit for a light-emitting device includes a light-emitting device, a data receiving unit, a storage unit, a driver unit and a voltage divider. The light-emitting device is applied with a voltage across its two ends. The data receiving unit receives a data signal. The storage unit stores a capacitor voltage, and a positive correlation exists between the capacitor voltage and the data signal. The driver unit is coupled to the light-emitting device, and the driver unit is turned on to drive the light-emitting device according to the capacitor voltage and to generate a threshold voltage of the driver unit. The voltage divider is coupled between the data receiving circuit and the light-emitting device and turned on by the capacitor voltage to generate a divided voltage. The voltage divider detects a voltage variation in the threshold voltage and in a voltage across the light-emitting device and adjusts the divided voltage according to the voltage variation.

Embodiments of the driver circuit for a light-emitting device of the invention use a voltage division method to generate a divided voltage, and the variation in the threshold voltage of a thin film transistor (TFT) and in the voltage across a light-emitting device is compensated for by the divided voltage to improve luminance uniformity.

The following detailed description refers to the accompanying drawings which show, by way of illustration, various embodiments in which the invention may be practiced. These embodiments are described in sufficient detail to enable those skilled in the art to practice these and other embodiments. The various embodiments are not necessarily mutually exclusive, as some embodiments can be combined with one or more other embodiments to form new embodiments. The following detailed description is, therefore, not to be taken in a limiting sense.

DETAILED DESCRIPTION OF THE INVENTION

More illustrative information will now be set forth regarding various optional architecture and features with which the foregoing functionality may or may not be implemented, per the desires of the user. It should be strongly noted that the following information is set forth for illustrative purposes and should not be construed as limiting in any manner Any of the following features may be optionally incorporated with or without the exclusion of other features described.

In the following embodiments of the invention, a light emitting device may be an organic light-emitting diode (OLED) or a different kind of light-emitting device.

Figure 1:
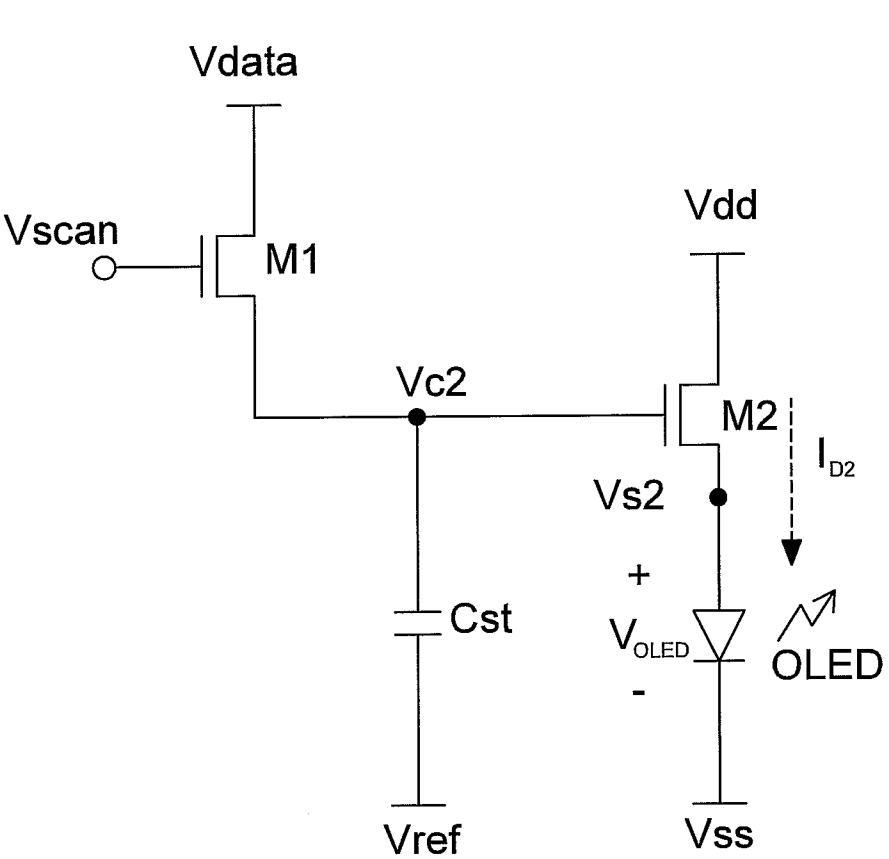
Fig. 1 (Prior Art)
FIG. 1 is a schematic diagram of a typical pixel circuit for an AM-OLED flat panel display.
Figure 2:
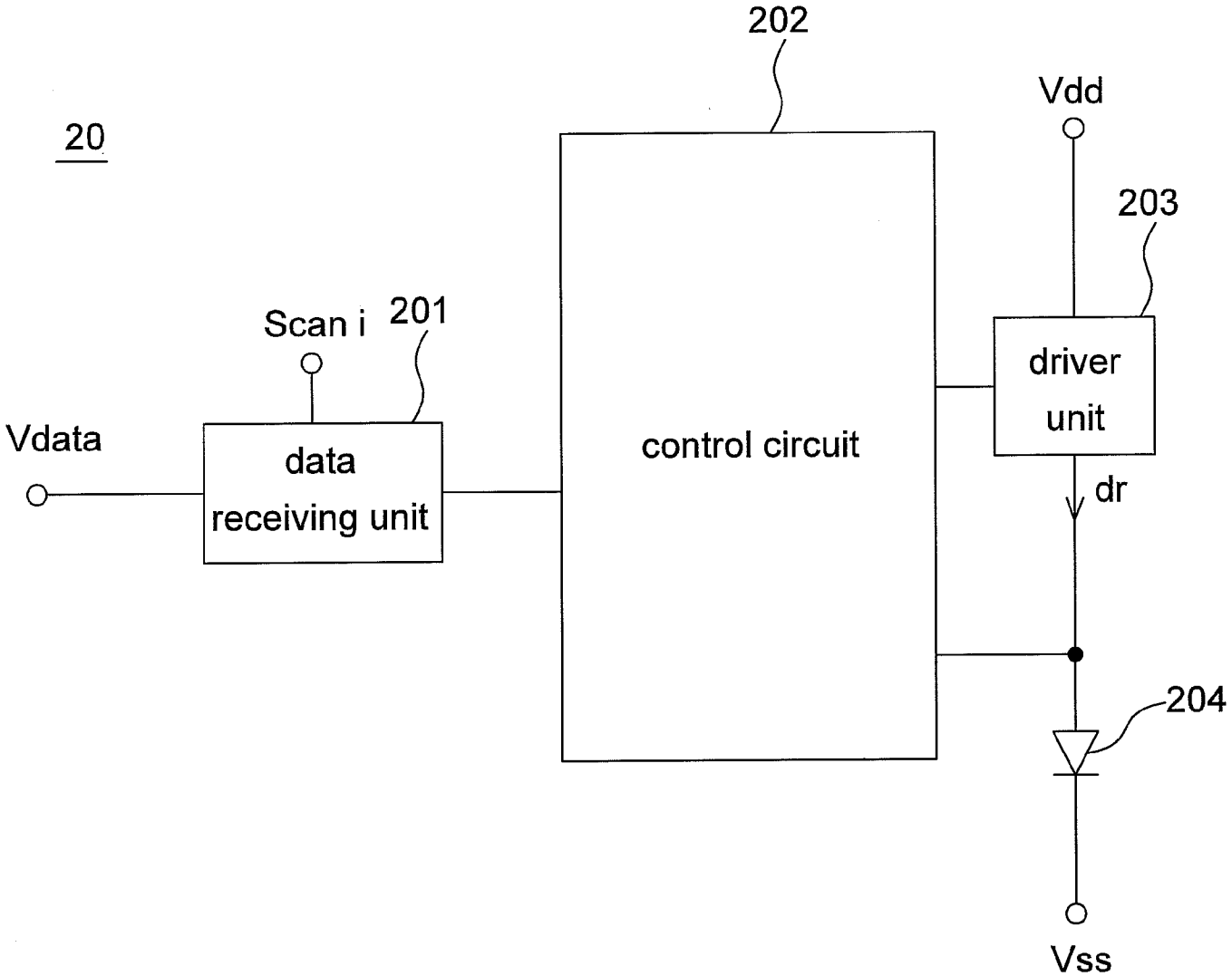
FIG. 2 is a schematic diagram illustrating an embodiment of a driver circuit for a light-emitting device.

FIG. 2 is a schematic diagram illustrating an embodiment of a driver circuit for a light-emitting device 20. The driver circuit 20 includes a data receiving unit 201, a control circuit 202, a driver unit 203 and a light-emitting device 204. The data receiving unit 201 receives a data signal Vdata and determines whether or not to output the data signal Vdata according to a scan signal Scan i. The control circuit 202 receives the data signal Vdata and is coupled to the data receiving unit 201, the driver unit 203 and the light-emitting device 204. The driver unit 203 is coupled to a voltage Vdd and the control circuit 202, and the driver unit 203 generates a drive signal dr for the light-emitting device 204 according to the data signal Vdata provided by the control circuit 202. One end of the light-emitting device 204 is coupled to the driver unit 203 and the control circuit 202, and another end of the light-emitting device 204 is coupled to a reference voltage Vss, such as ground potential. The output luminance of the light-emitting device 204 varies according to the drive signal dr. For example, the drive signal dr may be in the form of a drive current, and the light-emitting device 204 is controlled by the drive current to emit light. Moreover, the control circuit 202 detects or records the state of the driver unit 203 and/or the light-emitting device 204 and adjusts a magnitude of the drive signal dr according to the variation of the state to control a current flowing through the light-emitting device 204.

Though the drive signal dr is in the form of a current in the above embodiment, this is not limited. In an alternate embodiment, the drive signal dr may be in the form of a voltage. Further, the afore-mentioned state of the driver unit 203 or the light-emitting device 204 means a variation in a threshold voltage of the driver unit 203 or a variation in a voltage across the light-emitting device 204. In one embodiment, the variation may vary over time. For instance, after the driver unit 203 and/or the light-emitting device 204 operates for a long time, a threshold voltage of the driver unit 203 or a voltage across the light-emitting device 204 may deviate from its original value to result in the variation due to stress effects caused by temperature, voltage, current, etc. Particularly, the variation may become greater as time goes by.

As mentioned above, electrical characteristics of elements of the driver unit 203(such as a transistor or a light-emitting device) may change over time. For example, a threshold voltage of a thin film transistor or a voltage across an OLED may change over time to alter a current flowing through the light-emitting device. Therefore, in order to solve this problem, the control circuit 202 in one embodiment may detect or record the state variation of the driver unit 203 or the light-emitting device 204 and adjusts the drive signal dr according to the state variation to control the current flowing through the light-emitting device 204. Consequently, the current flowing through the light-emitting device 20 is kept stabile to provide uniform luminance of a display panel.

Figure 3A:
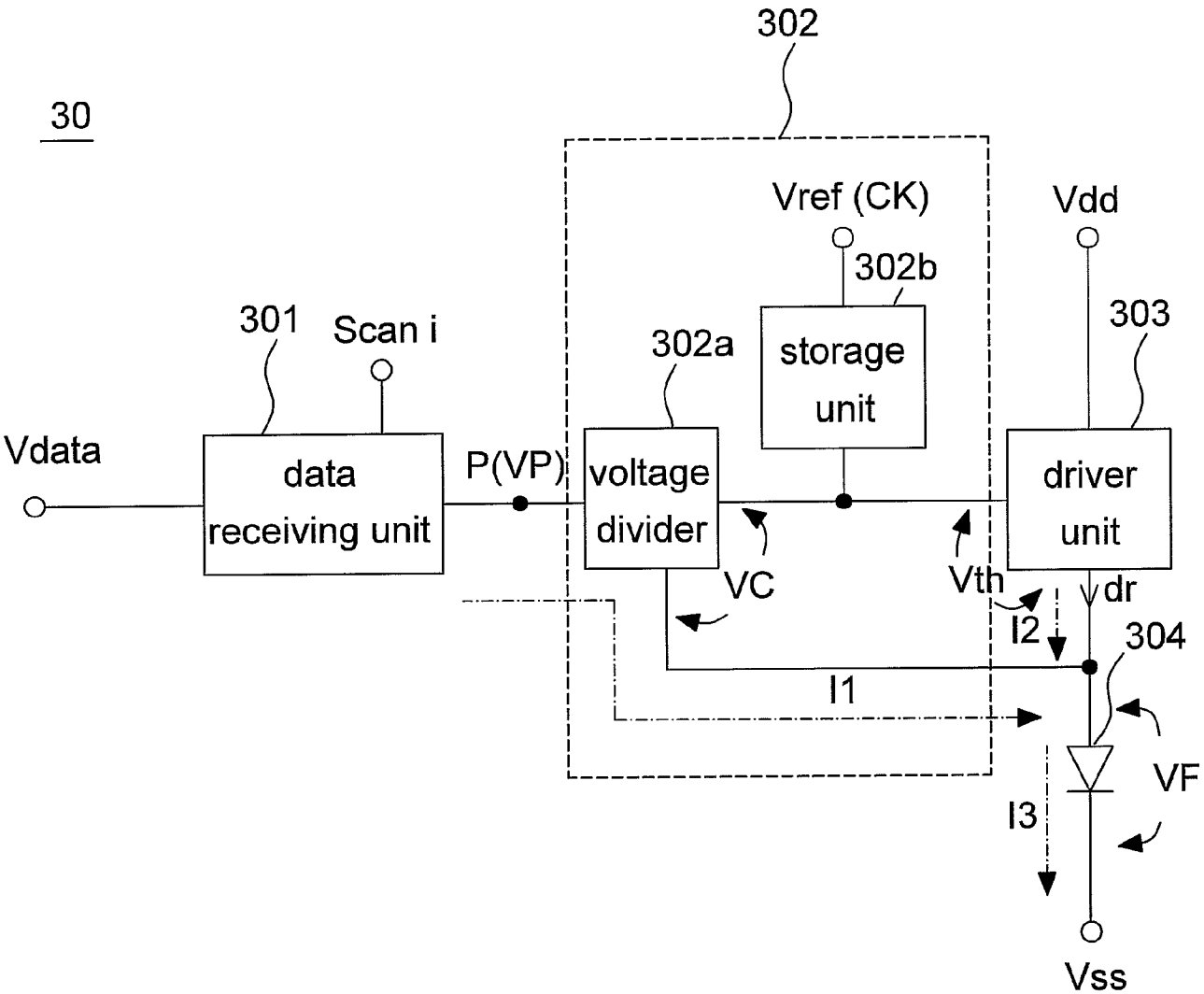
FIG. 3A is schematic diagrams illustrating another embodiment of a driver circuit for a light-emitting device.
Figure 3B:
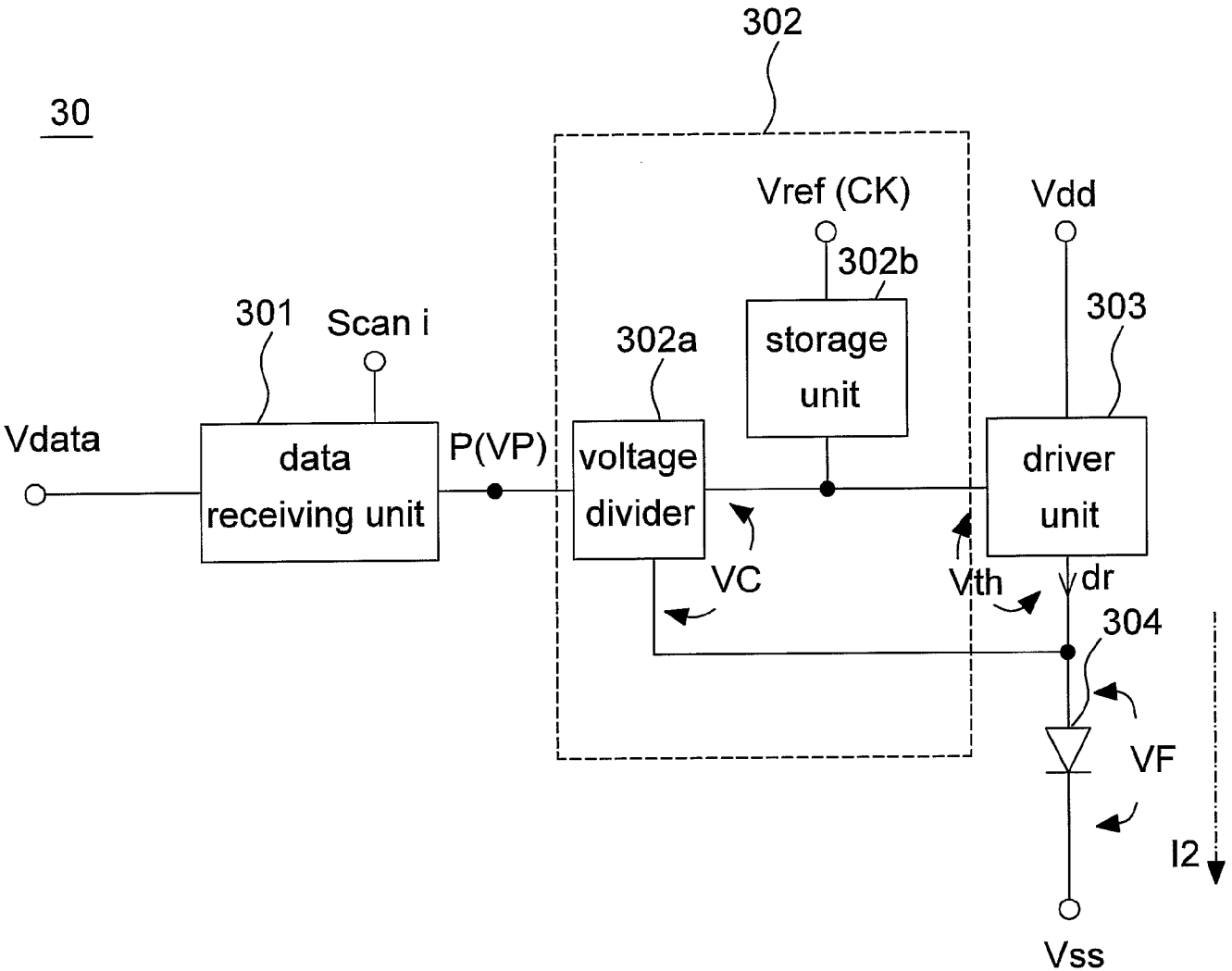
FIG. 3B is schematic diagrams illustrating another embodiment of a driver circuit for a light-emitting device.

FIGS. 3A and 3B are schematic diagrams illustrating another embodiment of a driver circuit for a light-emitting device 30. The driver circuit 30 includes a data receiving unit 301, a control circuit 302, a driver unit 303 and a light-emitting device 304. Further, the control circuit 302 includes a voltage divider 302*a* and a storage unit 302*b*. In an embodiment, the storage unit 302*b* may be a capacitor or a different kind of energy storage element. One end of the storage unit 302*b* is coupled between the voltage divider 302*a* and the driver unit 303, and another end is coupled to a reference voltage Vref, such as ground potential.

In this embodiment, the data receiving unit 301 receives a data signal Vdata to determines whether or not to output the data signal Vdata according to a scan signal Scan i. The driver unit 303 is coupled to the light-emitting device 304 and generates a drive signal dr to drive the light-emitting device 304 according to a capacitor voltage stored in the storage unit 302*b*.

A first end of the voltage divider 302*a* is coupled to the data receiving unit 301 to form a node P, a second end of the voltage divider 302*a* is coupled to the light-emitting device 304, and a third end of the voltage divider 302*a* is coupled to the storage unit 302*b*. In conventional designs, if a voltage across a driver unit or a light-emitting device varies, a drive current flowing through the light-emitting device may also change to affect the output luminance of the light-emitting device. Since a display panel includes many light-emitting devices, the luminance differences among light-emitting devices may cause luminance non-uniformity of a display panel. According to the above embodiment, the voltage divider 302*a* may generate a compensating voltage VC whose magnitude is corresponding to a threshold voltage Vth of the driver unit 303. As the threshold voltage Vth varies, the magnitude of the compensating voltage VC changes accordingly to change the current I1 flowing through the light-emitting device 304 and supplied by the voltage divider 302*a*. This compensates the variation in the voltage across the driver unit 303 and the light-emitting device 340 to improve luminance uniformity.

An embodiment of the storage unit 302*b* may be a capacitor. In another embodiment, the storage unit 302*b* may receive a reference voltage Vref and stores a divided voltage VP on a node P to drive the drive unit 303. The capacitor voltage stored by the storage unit 302 is substantially equal to the divided voltage VP, and a positive correlation exists between the capacitor voltage and the data signal Vdata. In other words, the capacitor voltage increases as the data signal Vdata increases, and the capacitor voltage decreases as the data signal Vdata decreases. In an alternate embodiment, the storage unit 302*b* may receive a clock signal CK and determine when to store the data signal Vdata according to the clock signal CK. For example, the storage unit 302*b* may use a first voltage level and a second voltage level to alternately enable and disable the voltage divider 302*a* and the driver unit 302*b*. Note that the first voltage level and the second voltage level of the clock signal CK are not limited to be a zero voltage and a negative voltage according to this embodiment, and that other values of two different voltage levels capable of alternately enabling and disabling the voltage divider 302*a* and the driver unit 303 may be also used. These modifications or changes are within the scope of the invention.

As shown in FIG. 3A, in one embodiment, the first voltage level of the clock signal CK of is set as zero, and the second voltage level is set as a negative voltage. The storage unit 302*b* uses the zero voltage and the negative voltage to alternately enable and disable the voltage divider 302*a* and the driver circuit 302*b*. A divided voltage VP is established at the node P when the data signal Vdata is written in. As the storage unit 302*b* is a capacitor receiving a zero voltage level of the clock signal CK and the voltage divider 302*a* is turned on, the voltage level of the divided voltage VP is higher than the zero voltage level of the clock signal CK, so that the capacitor is charged to enable the driver unit 303, with the capacitor voltage stored in the capacitor being substantially equal to the divided voltage VP. On the contrary, as the capacitor receives a negative voltage level of the clock signal CK, the level of the capacitor voltage drops to a negative voltage level due to the principle of conservation of charge. Therefore, the capacitor disables the driver unit 303 and the voltage divider 302*a* to a relaxation state. As mentioned above, the storage unit 302*b* may use the clock signal CK to control the voltage divider 302*a* and the driver unit 303 and allow them to alternate between a driving state and a relaxation state. Especially, once a transistor (such as a thin film transistor) exists in the voltage divider 302*a* or the driver unit 303, the alternate driving and relaxation states may extend the service life of a transistor.

Herein, the duration of a complete image frame includes a data written period and a light emission period. The operation of the driver circuit in a data written period and a light emission period is exemplified below.

As shown in FIG. 3A, under the data written period, the scan signal Scan i first enables the data receiving unit 301 to receive the data signal Vdata. At this time, the data receiving unit 301, the voltage divider 302*a* and the light-emitting device 304 form a loop to generate a first current I1 flowing through the loop. Further, the divided voltage VP at the node P is established by the first current I1 flowing through the voltage divider 302*a* and the light-emitting device 304. Meanwhile, a circuitry (not shown) sets the reference voltage Vref or the clock signal CK to have a zero voltage level, so that a capacitor voltage stored by the storage unit 302*b* is substantially equal to the divided voltage VP. Besides, the driver unit 303 is turned on by the divided voltage VP to allow the driver unit 303 and the light-emitting device 304 to form another loop, so a second current I2 flowing through the driver circuit 303 is generated. As shown in FIG. 3A, after the first current I1 and the second current I2 are brought together to generate a third current I3, the third current I3 flows through the light-emitting device 304 to allow the light-emitting device 304 to emit light. Here, the data written period is a part of the duration of a complete image frame. In one embodiment, the data written period may be equal to the width of a gate pulse, about tens of micro seconds.

Note that, as the voltage divider 302*a* and the driver unit 303 are both turned on, the voltage divider 302*a* and the driver unit 303 are electrically connected in parallel. Therefore, the voltage across the voltage divider 302*a* (defined as a compensating voltage VC) is equal to the threshold voltage Vth of the driver unit 303. Also, the divided voltage VP is substantially equal to a sum of the compensating voltage VC and the voltage VF across the light-emitting device 304.

Referring to FIG. 3B, under the light emission period, the scan signal Scan i turns off the data receiving unit 301 and the voltage divider 302*a*. At this time, the data receiving unit 301 does not receive the data signal Vdata, and a circuitry sets the reference voltage Vref or the clock signal CK to be a zero voltage level, so that the driver unit 303 is continually turned on by the divided voltage VP stored in the storage unit 302*b* to let the second current I2 flow through the light-emitting device 304 to emit light. Here, the light emission period is a part of the duration of a complete image frame, and the light emission period is far larger than the data written period. For instance, the light emission period is almost equal to the duration of a complete image frame. Moreover, in an embodiment, under the light emission period, the storage unit 302*b* enables the driver unit 303 to alternate between a driven (display) state and a relaxation state according to a clock signal CK. Specifically, the storage unit 302*b* may operate at a zero voltage level or a negative voltage level according to the clock signal CK to control the state of the second current I2 flowing through the light-emitting device 304.

Therefore, as the driver unit 303 and the light-emitting device 304 are driven for a long time to cause a variation in electrical characteristics (such as their resistance being increased) and an increase in the threshold voltages Vth and VF, the voltage divider 302*a*, under the data written period, may detect or record the variation in the threshold voltage Vth of the driver unit 303 and correspondingly adjust the value of the compensating voltage VC according to the variation. Thus, the value of the divided voltage VP is changed to allow the storage unit 302*b* to control the value of the second current I2 flowing through the driver circuit 303 under the light emission period. Further, as the voltage VF across the light-emitting device changes, the voltage divider 302*a*, under the data written period, may detect or record a variation in the voltage VF and adjust the divided voltage VP accordingly. Thus, the value of the second current I2 flowing through the light-emitting device 304 can be adjusted under the light emission period. The adjustment to the second current I2 may compensate the variation in a current flowing through the light-emitting device to result in stable and uniform light emission.

For example, when the threshold voltage Vth and the voltage VF are increased, the voltage divider 302 detects an increasing variation of the threshold Vth to increase the value of the compensating voltage VC accordingly. Meanwhile, the divided voltage is also increased to increase the conduction degree of the driver circuit 303, so that the second current I2 is increased to compensate a current decrease as a result of an increase in the voltages Vth and VF.

Therefore, the driver circuit for a light-emitting device according to the above embodiments is allowed to provide a stable current flowing through a light-emitting device to improve luminance uniformity.

Figure 4A:
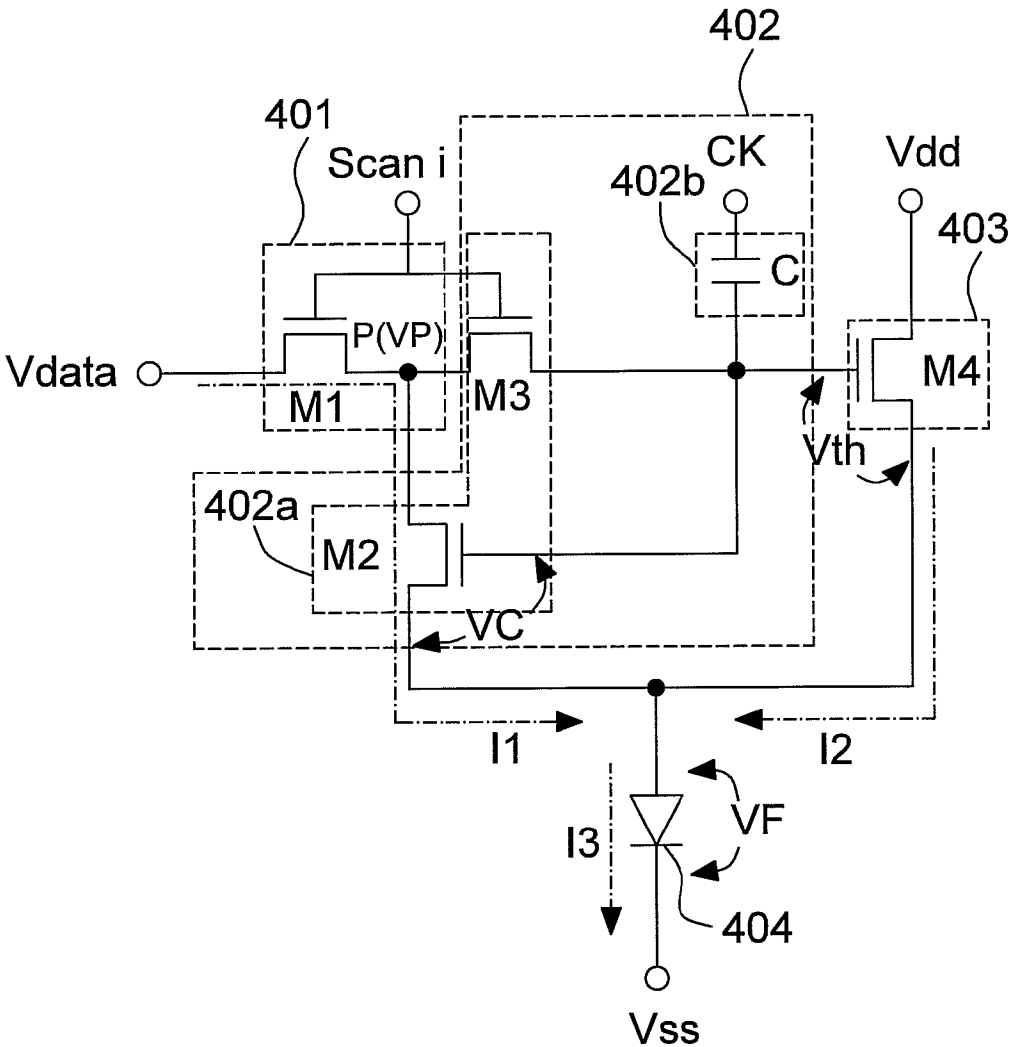
FIG. 4A is a schematic diagram illustrating another embodiment of the driver circuit for a light-emitting device.

FIG. 4A is a schematic diagram illustrating another embodiment of the driver circuit for a light-emitting device 40. According to an embodiment of the invention, the driver circuit for a light-emitting device 40 includes four transistors M1, M2, M3 and M4 and a capacitor C, namely a 4T1C architecture. The driver circuit for a light-emitting device 40 includes a data receiving unit 401, a control circuit 402, a driver unit 403 and a light-emitting device 404. Further, the control circuit 402 includes a voltage divider 402*a* and a storage unit 402*b*. The data receiving circuit 404 includes a first transistor M1. The voltage divider 402*a* includes a second transistor M2 and a third transistor M3. The storage unit 402*b* includes a capacitor C, and the driver circuit 403 includes a fourth transistor M4.

The first transistor M1 may determine when to output the data signal Vdata according to a scan signal Scan i. In an embodiment, the first transistor M1 includes a control terminal for receiving the scan signal Scan i, a first end for receiving the data signal Vdata, and a second end coupled to the second transistor M2 and the third transistor M3.

A first end of the capacitor C is coupled to a node P, and its capacitor voltage is substantially equal to the voltage VP. Actually, the third transistor M3 is coupled between the first end of the capacitor C and a second end of the first transistor M1. As the third transistor M3 is turned on, its conduction voltage drop is substantially equal to zero. In an embodiment, a second end of the capacitor C receives a clock signal CK and determines whether or not to store the capacitor voltage. Also, the capacitor C determines whether to transmit the stored capacitor voltage to the second transistor M2 and the fourth transistor M4 to enable or disable them according to the clock signal CK.

The second transistor M2, under the data written period, receives the divided voltage VP through the node P and generates a first current I1 flowing through the light-emitting device 404 to form a loop. In an embodiment, the second transistor M2 includes a control terminal for receiving the capacitor voltage, a first end coupled to the node P, and a second end coupled to the light-emitting device 404. The first end of the second transistor M2 receives the data signal Vdata through the node P to form the divided voltage VP at the node P. The control terminal of the second transistor M2, under the data written period, generates the first current I1 according to the capacitor voltage provided by the capacitor C, and the first current I1 flows through the second transistor M2.

The third transistor M3 is coupled to the second transistor M2 to form a diode connection configuration. A voltage (threshold voltage) across the second transistor M2 is formed on its control terminal and second end by means of the diode connection configuration. The voltage (threshold voltage) across the second transistor M2 is defined as a compensating voltage VC. The diode connection configuration may generate the compensating voltage VC in response to the scan signal Scan i. In an embodiment, the third transistor M3 includes a control terminal for receiving the scan signal Scan i, a first end coupled to the first transistor M1, and a second end coupled to the capacitor C.

Please note that the conduction voltage drop of the third transistor M3 is substantially equal to zero by a suitable aspect ratio (Width/Length) design. For example, the conduction voltage drop of the third transistor M3 may be about 0.1-0.2 volt which can be neglected. Therefore, the capacitor voltage stored in the capacitor C is substantially equal to the divided voltage VP.

The fourth transistor M4 has a threshold voltage Vth. The fourth transistor M4 generates a second current I2 to drive the light-emitting device 404 according to the divided voltage VP provided by the capacitor C. In an embodiment, the fourth transistor M4 includes a control terminal coupled to the capacitor C (the control terminal is control by the capacitor voltage of the capacitor C), a first end coupled to a voltage Vdd, and a second end coupled to the light-emitting device 404. Note that the divided voltage VP needs to be larger than the threshold voltage Vth to allow the second current I2 to flow through the fourth transistor M4. Under the data written period, the first current I1 and the second current I2 are brought together to generate a third current I3. Further, the third current I3 flows through the light-emitting device 404 to generate a voltage VF across the light-emitting device 404.

The third transistor M3 is coupled to the first transistor M1 to form the node P, and the voltage at the node P is defined as the divided voltage VP. As the transistors M2, M3 and M4 are turned on, the transistors M2 and M4 are electrically connected in parallel, and thus the threshold voltages of the transistors M2 and M4 are the same. Hence, the compensating voltage VC is equal to the threshold voltage Vth; that is, the compensating voltage VC changes according to the variation in the threshold voltage Vth. Also, the divided voltage VP is equal to the sum of the voltage VC and the voltage VF. Therefore, the divided voltage VP varies according to the variation of the compensating voltage VP. In other words, the divided voltage VP varies according to the threshold voltage Vth of the fourth transistor M4 or the voltage VF across the light-emitting device 404. Consequently, under data written period, the capacitor C may substantially store the divided voltage VP to detect or record the variation of the threshold voltage Vth. Further, under the light emission period, the driver circuit 40 adjusts the current I2 by the divided voltage VP to maintain stable and uniform light emission of the light-emitting device 404.

The embodiment of the driver circuit 40 for a light-emitting device establishes the divided voltage to record characteristic variation of circuit and adjust the threshold voltage Vth of a thin film transistor and the voltage across a light-emitting device according to recorded data. Thus, the characteristic variation of a thin film transistor and a light-emitting device is compensated.

Under the data written period, as shown in FIG. 4A, an $i_{th}$ scan line is enabled, and the transistors M1 and M3 are turned on to form a series connection. At this time, the transistor M1, the transistor M2 and the light-emitting device 404 forms a loop, and the voltage of the data signal Vdata is divided in the loop to establish the divided voltage at the node P. Here, a peak voltage value of the loop is equal to the voltage value of the data signal Vdata, and the divided voltage VP in the loop is substantially equal to the sum of the compensating voltage VC of the second transistor M2 and the voltage across the light-emitting device 404. Therefore, the divided voltage VP is in proportion to the data signal Vdata. In an embodiment, the relation between the divided voltage VP and the data signal Vdata is defined as:

$$VP = V\text{data} \times [(Ron_M2 + Ron_404)/(Ron_M2 + Ron_404 + Ron_M1)],$$

where Ron_M1, Ron_M2 and Ron_404 are conductive resistances of the transistor M1, the transistor M2 and the light-emitting device 404, respectively. Meanwhile, the capacitor C stores a capacitor voltage substantially equal to the divided voltage VP. When the electrical characteristic of the fourth transistor M4 or the light-emitting device 404 changes, such as the threshold voltage Vth of the fourth transistor M4 being increased, the conductive resistance of the fourth transistor M4 increases, and the conductive resistance of the second transistor M2 (Ron_M2) increases accordingly as a result of a parallel connection of the transistor M4 and the transistor M2. Therefore, the threshold voltage (compensating voltage VC) of the second transistor M2 also increases accordingly. In that case, the divided voltage VP at the node P is increased; that is, the capacitor voltage substantially equal to the divided voltage VP stored in the capacitor is also increased. Consequently, under the data written period, the capacitor C in the driver circuit 40 may record the variation of the threshold voltage Vth of the fourth transistor M4, as shown in FIG. 4A.

Figure 4B:
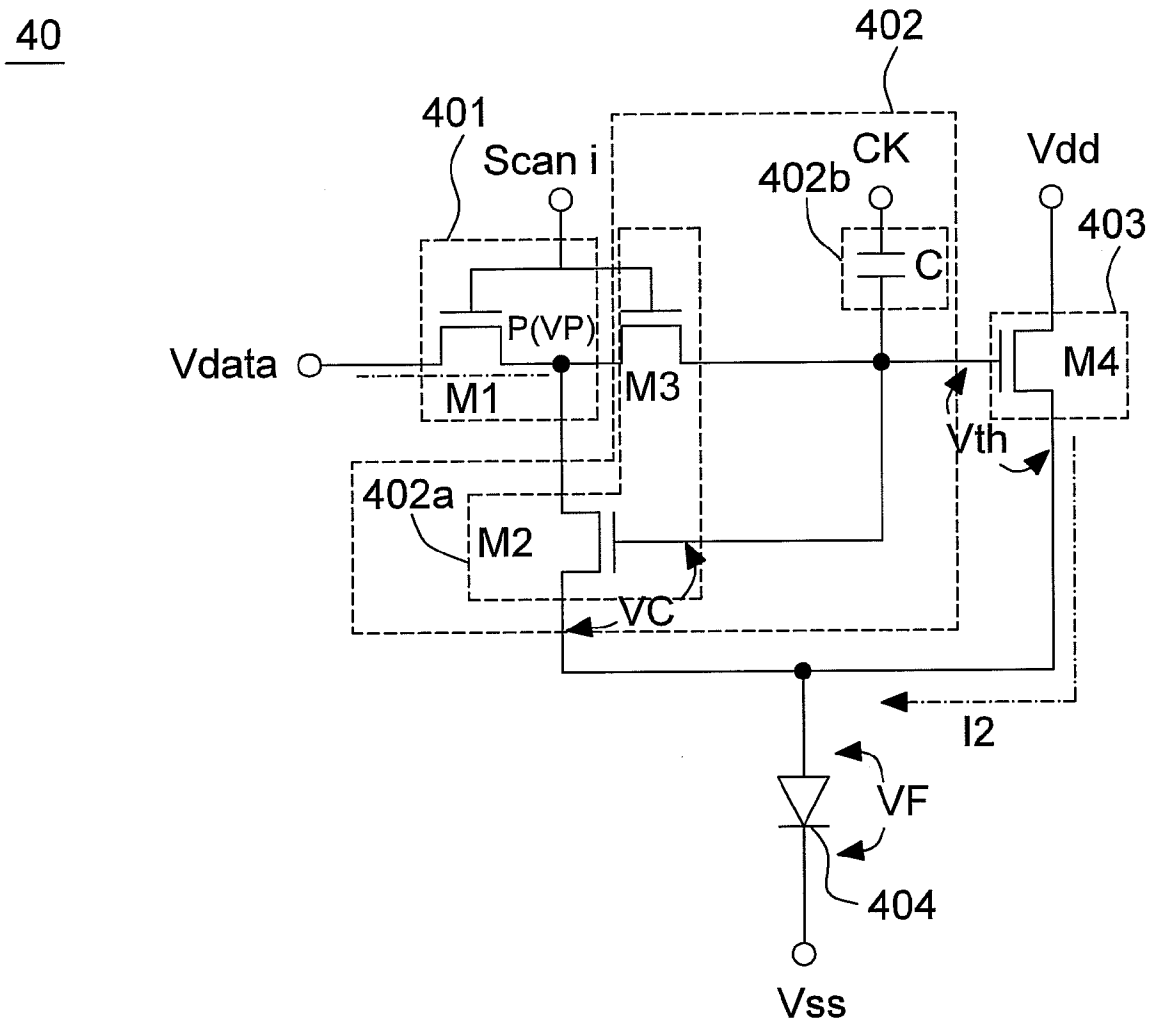
FIG. 4B is a schematic diagram illustrating another embodiment of the driver circuit for a light-emitting device.

Under the light emission period, as shown in FIG. 4B, the driver circuit 40 may use the capacitor voltage substantially equal to the divided voltage VP to drive the fourth transistor M4. Thus, as the threshold voltage Vth of the fourth transistor M4 is increased, the divided voltage VP stored in the capacitor C is correspondingly increased. Therefore, the driver circuit 40 may reduce the fluctuation in the current flowing through the light-emitting device 404 to avoid luminance non-uniformity.

In another embodiment, as the electrical characteristic of the light-emitting device 404 varies to increase the voltage VF across the light-emitting device 404, the conductive resistance of the light-emitting device is thus increased to reduce the third current I3 flowing through the light-emitting device 404, and the light-emitting device 404 dims as a result. In comparison, in the driver circuit 40 according to an embodiment of the invention, the divided voltage VP of the voltage divider 402*a* is increased to raise the divided voltage VP stored in the capacitor and the conduction ability of the second transistor M2 and the fourth transistor M4, under the light emission period shown in FIG. 4B. Therefore, the fluctuation in the current flowing through the light-emitting device 404 is reduced to maintain stable and uniform light emission of the light-emitting device 404.

According to the above embodiment, the gate/source of the fourth transistor M4 is connected with the gate/source of the second transistor M2 to form a parallel connection. Therefore, the second transistor M2 may generate a compensating voltage VC to record the variation in the threshold voltage Vth of the fourth transistor M4. Besides, the divided voltage VP is correspondingly increased or decreased to compensate the variation in the threshold voltage Vth of the fourth transistor M4 or the voltage across the light-emitting device 404. As a result, the luminance uniformity is improved.

Figure 5:
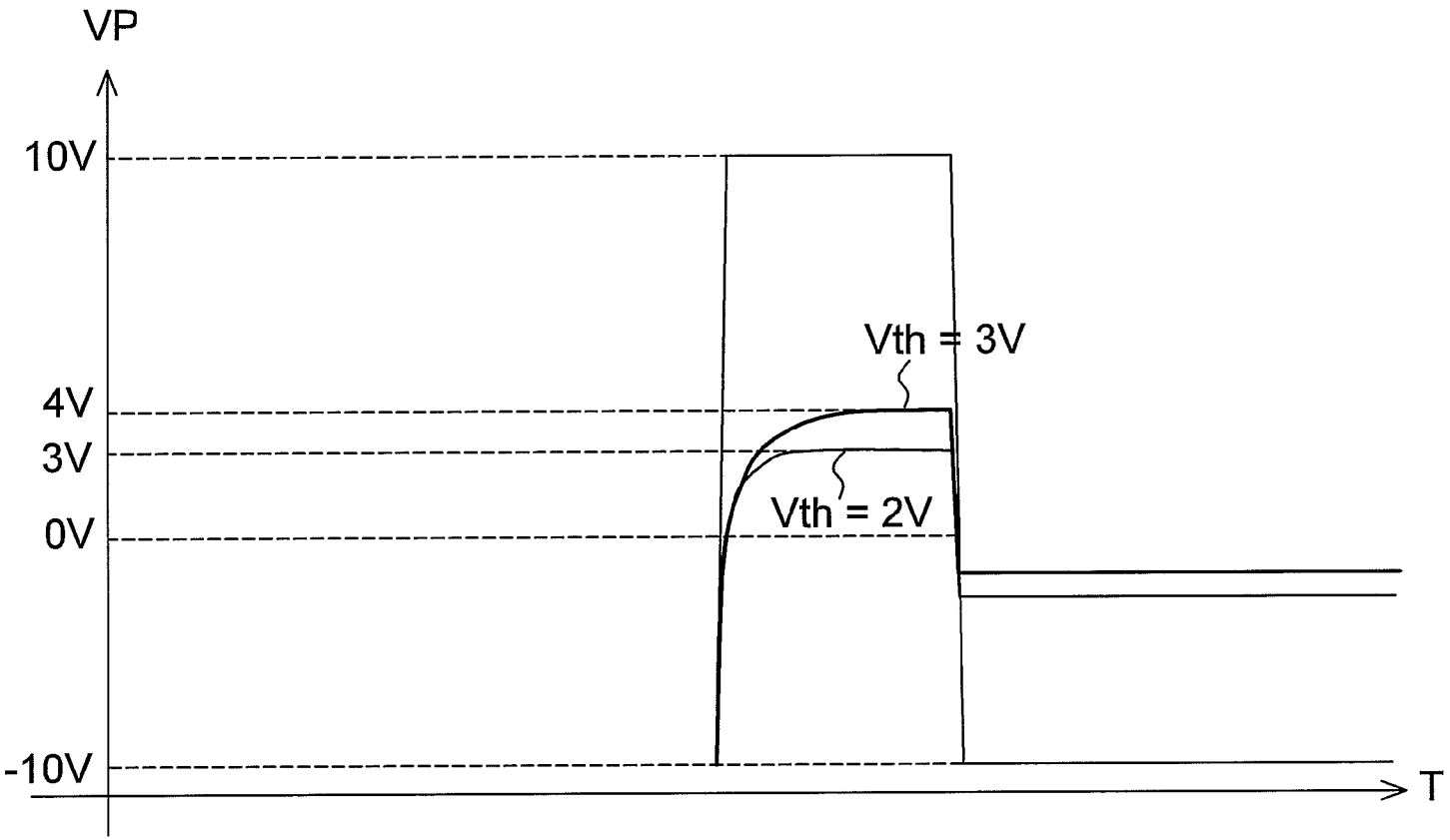
FIG. 5 shows a simulation diagram of the driver circuit for a light-emitting device described in the FIG. 4A and 4B.

FIG. 5 shows a diagram illustrating simulation results of the driver circuit shown in the FIG. 4A and 4B. The waveform shown in FIG. 5 illustrates the divided voltage VP on the node P varying over time T. Assume the threshold voltage of the fourth transistor M4 is 2V, the threshold voltage of the second transistor M2 connected with the fourth transistor M4 in parallel is 2V also. In that case, as shown in FIG. 5, the divided voltage VP on the node P is 3V. When the electrical characteristic of the fourth transistor M4 alters to cause its threshold voltage to vary from 2V to 3V, the threshold voltage of the second transistor M2 correspondingly varies from 2V to 3V. Therefore, a voltage drop on the node P is increased to 4V; that is, the divided voltage VP is increased to 4V as shown in FIG. 5. Therefore, it can be clearly seen the driver circuit for a light-emitting device according to the above embodiment may reduce the current fluctuation to improve luminance uniformity.

Note that different kinds of transistors, like a low-temperature poly-Si thin film transistor (LTPS TFT), a-Si TFT, IGZO TFT, Organic TFT, etc, and other driving or switching element are all suitable for different embodiments above. Moreover, the above-mentioned capacitor is coupled to a reference voltage Vref, and the reference voltage Vref may be a high-level voltage, a low-level voltage or a clock signal CK. In case the capacitor is coupled to the clock signal CK, a shift in the threshold voltage of a driving element may be mitigated. Further, in one embodiment, an aspect ratio (width/length) of the second transistor M2 is set as larger than an aspect ratio (width/length) of the first transistor M1. For example, the aspect ratio (width/length) of the second transistor M2 is 30/5, and the aspect ratio (width/length) of the second transistor M1 is 9/5. Accordingly, the conductive resistance of the second transistor M2 is small than that of the first transistor M1 to allow the first transistor M1 to have a preset voltage larger than that of the second transistor M2. Consequently, the divided voltage VP is small than the voltage of the data signal Vdata, and, under the light emission period, the voltage across the fourth transistor M4 and the light-emitting device 404 is substantially equal to the divided voltage VP to reduce the current flowing through the fourth transistor M4 and the light-emitting device 404. Under the circumstance, the fourth transistor M4 and the light-emitting device 404 may suffer less stress to extend their service life.

According to the above embodiments, a variation in the voltage of a thin film transistor and a light-emitting device is compensated for by a divided voltage to improve luminance uniformity. Further, in case one end of a storage capacitor is coupled to a clock signal, a driving thin film transistor of a display panel alternates between a display state and a relaxation state to therefore extend its service life.

While the invention has been described by way of examples and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest, interpretation so as to encompass all such modifications and similar arrangements.

What is claimed is:

1. A driver circuit for a light-emitting device, comprising:

a light-emitting device controlled by a driving current to emit light;

a first transistor for transmitting a data signal;

a second transistor coupled between the light-emitting device and the first transistor, wherein the second transistor is coupled to the first transistor to form a node and generate a divided voltage at the node;

a third transistor for transmitting the divided voltage;

a capacitor for storing a capacitor voltage, wherein the capacitor voltage is substantially equal to the divided voltage; and a fourth transistor coupled to the second transistor and the light-emitting device, wherein the fourth transistor has a threshold voltage, the threshold voltage is equal to a compensating voltage of the second transistor, and the fourth transistor is controlled by the capacitor voltage to generate the driving current;

wherein, during a data written period, the first transistor, the second transistor and the light emitting device form a loop, the divided voltage in the loop is in proportion to a voltage of the data signal and is substantially equal to the sum of the compensating voltage of the second transistor and the voltage across the light-emitting device, and the divided voltage is adjusted according to a voltage variation in the threshold voltage of the fourth transistor and the voltage across the light-emitting device.

2. The driver circuit for a light-emitting device of claim 1, wherein, during the data written period, the divided voltage varies according to the voltage across the light-emitting device and the threshold voltage of the fourth transistor, and the capacitor stores the capacitor voltage, and, during a light emission period, the fourth transistor drives the light-emitting device according to the capacitor voltage.

3. The driver circuit for a light-emitting device of claim 1, wherein one end of the capacitor receives a clock signal, and the capacitor enables or disables the second transistor and the fourth transistor according to the clock signal.

4. The driver circuit for a light-emitting device of claim 1, wherein the first transistor comprises a control terminal for receiving a scan signal, a first end for receiving the data signal, and a second end coupled to the second transistor and the third transistor.

5. The driver circuit for a light-emitting device of claim 1,wherein the third transistor comprises a control terminal for receiving a scan signal, a first end coupled to the first transistor to form the node, a second end coupled to the capacitor, and a voltage on the node varies according to a voltage across the fourth transistor.

6. The driver circuit for a light-emitting device of claim 1, wherein the second transistor comprises a control terminal for receiving the capacitor voltage, a first end coupled to the node, and a second end coupled to the light-emitting device.

7. The driver circuit for a light-emitting device of claim 1, wherein the fourth transistor comprises a control terminal for receiving a capacitor voltage, a first end coupled to a voltage, and a second end coupled to the light-emitting device.

8. The driver circuit for a light-emitting device of claim 1, wherein the third transistor is coupled to the second transistor to form a diode connection configuration so as to generate the compensating voltage.

9. The driver circuit for a light-emitting device of claim 1, wherein an aspect ratio of the first transistor is small than an aspect ratio of the second transistor.

10. The driver circuit for a light-emitting device of claim 1, wherein a conduction voltage drop of the third transistor is substantially equal to zero.

11. A driver circuit for a light-emitting device, comprising:

a light-emitting device applied with a voltage across its two ends;

a data receiving unit for receiving a data signal;

a storage unit for storing a capacitor voltage, wherein a positive correlation exists between the capacitor voltage and a voltage of the data signal;

a driver unit coupled to the light-emitting device, wherein the driver unit is turned on to drive the light-emitting device according to the capacitor voltage and to generate a threshold voltage of the driver unit; and a voltage divider coupled between the data receiving circuit and the light-emitting device and turned on by the capacitor voltage to generate a divided voltage;

wherein, during a data written period, the divided voltage is substantially equal to the sum of the threshold voltage of the driver unit and the voltage across the light-emitting device, and the voltage divider detects a voltage variation in the threshold voltage and in the voltage across the light-emitting device and adjusts the divided voltage according to the voltage variation.

12. The driver circuit for a light-emitting device of claim 11, wherein the data receiving unit comprises a first transistor, and the first transistor has a control terminal for receiving a scan signal, a first end for receiving the data signal and a second end coupled to a second transistor and a third transistor.

13. The driver circuit for a light-emitting device of claim 12, wherein the voltage divider comprises:

the second transistor comprising a control terminal for receiving the capacitor voltage, a first end coupled to a node and a second end coupled to the light-emitting device; and the third transistor comprising a control terminal for receiving the scan signal, a first end coupled to the first transistor and a second end coupled to the storage unit, wherein the node is the point where the first end of the third transistor and the first transistor meet, and the voltage on the node varies according to the threshold voltage and the voltage across the light-emitting device.

14. The driver circuit for a light-emitting device of claim 13, wherein an aspect ratio of the first transistor is small than an aspect ratio of the second transistor.

15. The driver circuit for a light-emitting device of claim 13, wherein the third transistor is coupled to the second transistor to form a diode connection configuration.

16. The driver circuit for a light-emitting device of claim 13, wherein the conduction voltage drop of the third transistor is substantially equal to zero.

17. The driver circuit for a light-emitting device of claim 13, wherein the second transistor being turned on generates a compensating voltage equal to the threshold voltage.

18. The driver circuit for a light-emitting device of claim 13, wherein the driver unit comprises a fourth transistor for generating the threshold voltage when being turned on, and the second transistor and the fourth transistor are coupled in parallel when the third transistor being turned on.

* * * * *